US007810440B2

(12) United States Patent
Ward

(10) Patent No.: US 7,810,440 B2
(45) Date of Patent: Oct. 12, 2010

(54) WIRE SHELF COVER SYSTEM

(76) Inventor: Sidney Ward, 1123 Zonolite Rd. NE., Suite 30, Atlanta, GA (US) 30306

( * ) Notice: Subject to any disclaimer, the term of this patent is extended or adjusted under 35 U.S.C. 154(b) by 811 days.

(21) Appl. No.: 11/506,326

(22) Filed: Aug. 18, 2006

(65) Prior Publication Data

US 2008/0041804 A1 Feb. 21, 2008

(51) Int. Cl.

| | |
|---|---|
| ***A47B 47/06*** | (2006.01) |
| ***A47B 96/02*** | (2006.01) |
| ***A47B 55/02*** | (2006.01) |
| ***B65D 65/24*** | (2006.01) |

(52) U.S. Cl. ..... 108/90; 108/161; 150/158

(58) Field of Classification Search ..... 211/183, 211/184, 153, 119.003, 90.03; 108/60, 90, 108/27, 181, 161; 150/158

See application file for complete search history.

(56) References Cited

U.S. PATENT DOCUMENTS

| | | | | |
|---|---|---|---|---|
| 1,979,578 | A * | 11/1934 | Simmons | 428/126 |
| 3,501,020 | A * | 3/1970 | Krikorian | 211/184 |
| 3,554,383 | A * | 1/1971 | Ball | 211/153 |
| 4,890,746 | A * | 1/1990 | Trulaske, Sr. | 211/59.2 |
| 5,228,581 | A * | 7/1993 | Palladino et al. | 211/153 |
| 5,538,147 | A * | 7/1996 | Fucci | 211/153 |
| 5,597,077 | A * | 1/1997 | Hartmann | 211/134 |
| 5,697,302 | A * | 12/1997 | Putnam | 108/90 |
| 6,401,945 | B1 | 6/2002 | Gawel | |
| D459,925 | S | 7/2002 | Gawel | |
| 6,725,785 | B2 * | 4/2004 | Wang | 108/90 |
| 7,066,563 | B2 * | 6/2006 | Berger | 312/348.3 |
| 2002/0170870 | A1 * | 11/2002 | Callis | 211/119.003 |
| 2004/0004052 | A1 | 1/2004 | Young | |

* cited by examiner

*Primary Examiner*—Michael Safavi
(74) *Attorney, Agent, or Firm*—Alston + Bird LLP

(57) ABSTRACT

A shelf cover for open-wire shelving is provided, comprising a semi-rigid sheet adapted to cover the top panel and front panel of the shelving, wherein the sheet further includes an extended portion adapted to wrap under the front panel, the extended portion further including a securing device for securing the extended portion to wires on the front panel. In one embodiment, the extended portion includes a plurality of tabs adapted to fit securely behind the wires of the front panel. In another embodiment, the extended portion includes a plurality of retaining buttons adapted to fit securely between adjacent wires of the front panel.

11 Claims, 7 Drawing Sheets

WIRE SHELF COVER SYSTEM

BACKGROUND OF THE INVENTION

I. Field of the Invention

The present invention relates generally to devices and methods used to cover storage shelving, and more particularly to such coverings for wire-type shelving.

II. Background and Prior Art

Shelving used in storage compartments, bookcases, cupboards and medicine cabinets may be made from a variety of materials such as wood, glass, plastic, etc. One popular approach is to use a vinyl-coated wire-frame construction, which typically uses two or more members running the length of the shelf with a number of closely spaced cross-members. Such shelving systems are available from several manufacturers including ELFA™ and Closet Maid™. They are found in almost every new developer grade home and apartment in the United States. This structure, which can include a front grating, is generally aesthetically pleasing, and both lightweight and inexpensive, because it uses substantially less material than traditionally used to create the same amount of shelf space. A limitation of these shelves, however, is that any articles dimensioned smaller than the distance between any two adjacent cross-members will fall through the shelf. Similarly, any object not substantially larger than the distance between any two adjacent cross-members will tend to tilt to one side or another. These limitations tend to frustrate the purpose of shelving, that is, to permit the user to store items efficiently and neatly in a given storage area. Thus it would be desirable to provide a means for storing such smaller dimensioned items neatly stored on wire-frame shelves while preserving the advantages of such shelving.

Conventional flexible shelf coverings are commercially available that are made from paper, plastic, vinyl and other flexible materials. Because these materials are inherently flexible, they can be conveniently marketed in rolls. Such coverings as are designed for solid shelves typically do not provide adequate support on a wire-frame shelf, and can be easily damaged, requiring frequent replacement. Also, because they are very lightweight, conventional coverings are easily displaced from their intended position, and thus require some form of adhesive layer to bond them to the surface to which they are applied.

A somewhat thicker flexible shelf covering is disclosed in Putnam, U.S. Pat. No. 5,697,302, that provides a shelf cover for wire-frame shelves constructed from a relatively thick but flexible material. The material is intended to be sufficiently thick to avoid deformation when placed on a wire-frame shelf yet be sufficiently flexible to be rolled up for storage or sale. The material may also have a lateral notch along the underside of the cover so that a portion of the cover may be folded down to cover the frontal grating of the shelf. Because the material is inherently heavy, it tends to add significantly to the weight load borne by the underlying shelf without contributing any load supporting capacity other than for very small articles. The lower side of the material is preferably coated with an adhesive or otherwise treated to prevent slippage of the shelf-covering material on the wire frame. However the adhesive or otherwise treated surface tends, over time, to attract and retain dust and dirt thereby detracting from the generally aesthetically pleasing quality for which such wire shelving is initially selected.

Accordingly, the present invention provides a semi-rigid shelf covering formed generally of an extruded plastic such as virgin or reclaimed polycarbonate (PC), acrylonitrile butadiene styrene (ABS), polyphenylene oxide (PPO), high-density polyethylene (HDPE), polyethyene terephthalate (PET), polyvinyl chloride (PVC), polypropylene (PP), and polystyrene (PS), and blends thereof. The plastics can be unpigmented and even substantially transparent or translucent so as to retain the overall appearance of the underlying open-wire shelving. Alternatively, the plastics can be pigmented to exhibit desirable coordinating colors to the underlying open-wire shelving. Generally, the material forming the rigid shelf covering in accordance with the present invention is between about 1 and 5 mm in thickness.

One feature of the semi-rigid shelf covering of the present invention is its rigidity, which is sufficient to avoid deformation between the cross members of the shelf, thereby being able to support footed articles that may have sufficient mass to substantially deform the flexible shelf coverings of the prior art. The semi-rigid character of the shelf covering of the present invention distributes any load placed on the covering over a wide area of the shelf, yet is itself very light, thereby not detracting significantly from the load-supporting capability of the underlying open-wire shelving.

Another feature of the present invention is the extended portion which wraps around the front panel of the shelf and is secured to the wires themselves, thereby providing a shelf covering that will not be easily displaced from the underlying shelf. As will be described in further detail below, such securing means may be either tabs which slip behind the wires or retaining buttons which resiliently fit securely between adjacent wires.

SUMMARY OF THE INVENTION

Therefore, one object of the present invention is to provide a cover system for wire shelving which can be cut for desired lengths.

It is also an object of the present invention to provide a cover system for wire shelving which is easily secured to the shelving.

A further object of the present invention is to provide a cover system for wire shelving which can be manufactured in a variety of colors or tranluscent.

Accordingly, a shelf cover for open-wire shelving is provided, comprising a semi-rigid sheet adapted to cover the top panel and front panel of the shelving, wherein the sheet further includes an extended portion adapted to wrap under the front panel, the extended portion further including a securing device for securing the extended portion to wires on the front panel. In one embodiment, the extended portion includes a plurality of tabs adapted to fit securely behind the wires of the front panel. In another embodiment, the extended portion includes a plurality of retaining buttons adapted to fit securely between adjacent wires of the front panel.

In order to accomplish the goal of being semi-rigid and serving as a continuous shelf, the sheet is between about 1 and 5 mm in thickness and capable of being cut to a predetermined length. The sheet is formed from a compound such as polycarbonate (PC), acrylonitrile butadiene styrene (ABS), polyphenylene oxide (PPO), high-density polyethylene (HDPE), polyethyene terephthalate (PET), polyvinyl chloride (PVC), polypropylene (PP), and polystyrene (PS), or blends thereof. In a more specific embodiment, the sheet may be pigmented in a predetermined color or it may be at least partially translucent.

To facilitate installation of the shelf cover, the sheet includes score lines corresponding to folds in the sheet when applied to the open-wire shelving. Optionally, the sheet includes perforations sufficient to permit air circulation through the shelf cover.

DETAILED DESCRIPTION OF THE PREFERRED EMBODIMENTS

Figure 1:
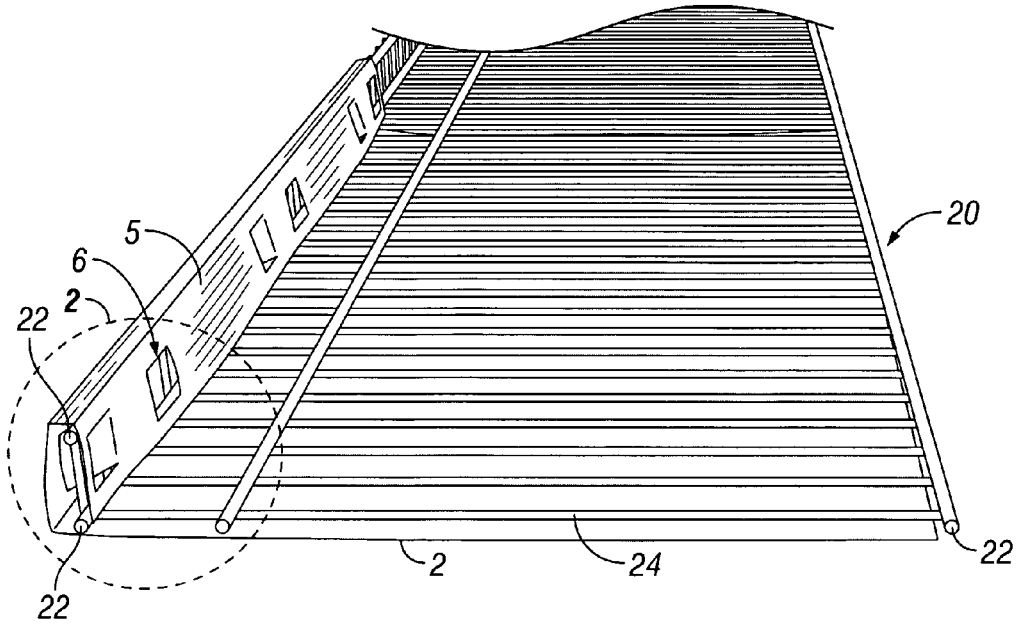
FIG. 1 depicts a bottom view of a typical wire shelf having a cover in accordance with the present invention.

Turning now to FIG. 1, a conventional wire-frame shelf 20 is shown in an inverted position to better illustrate and describe the present invention. The shelf 20 is composed of at least three parallel longitudinal members 22 spanned by numerous parallel wires 24. The wires 24 are separated by a predetermined distance which may vary depending on the size and intended use of the shelf. For instance, smaller shelves used in medicine cabinets may have a distance s of about 1 cm, whereas larger shelves used for storage closets may have a distance of about 2 cm or more. In most shelving systems, the shelf includes a top panel 26 and a front panel 28. Despite the utility of wire shelves 20, however, there are some significant disadvantages. For example, items that have supporting structures that are not substantially larger than the distance between wires 24 will tend to topple or fall through the shelf 20. This frustrates the intended purpose of the shelf 20, which is to allow the orderly storage of various items, regardless of size.

FIG. 1 also depicts a preferred embodiment of the present invention in the form of a shelf cover 1 comprising a thin, semi-rigid extruded sheet 2 adapted to cover the top panel 26 and front panel 28 of the shelving, wherein the sheet 2 further includes an extended portion 5 adapted to wrap under the front panel 28. The extended portion 5 further includes a securing device 6 for securing the extended portion 5 to wires 24 on the front panel 28.

Figure 2:
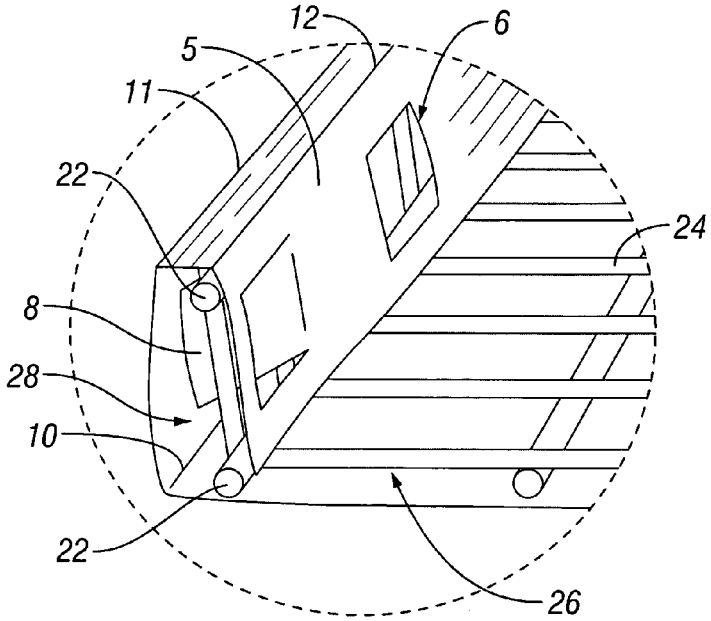
FIG. 2 depicts a detailed view of the cover of FIG. 1, further illustrating a tab method of securing one end of the cover to the shelf.
Figure 3:
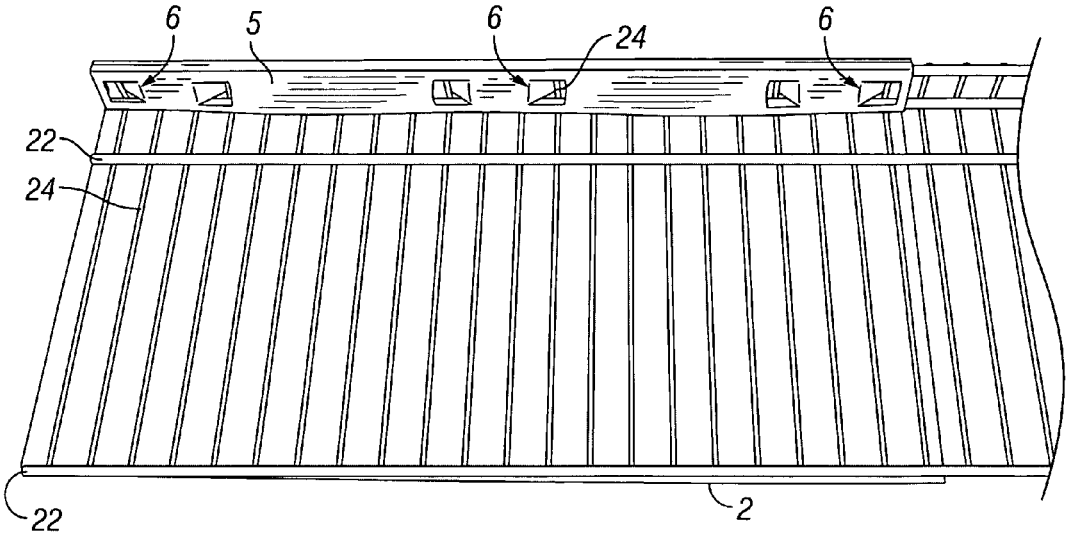
FIG. 3 depicts another bottom view of the present invention illustrating the spacing of the tabs on the front panel of the shelf.
Figure 4:
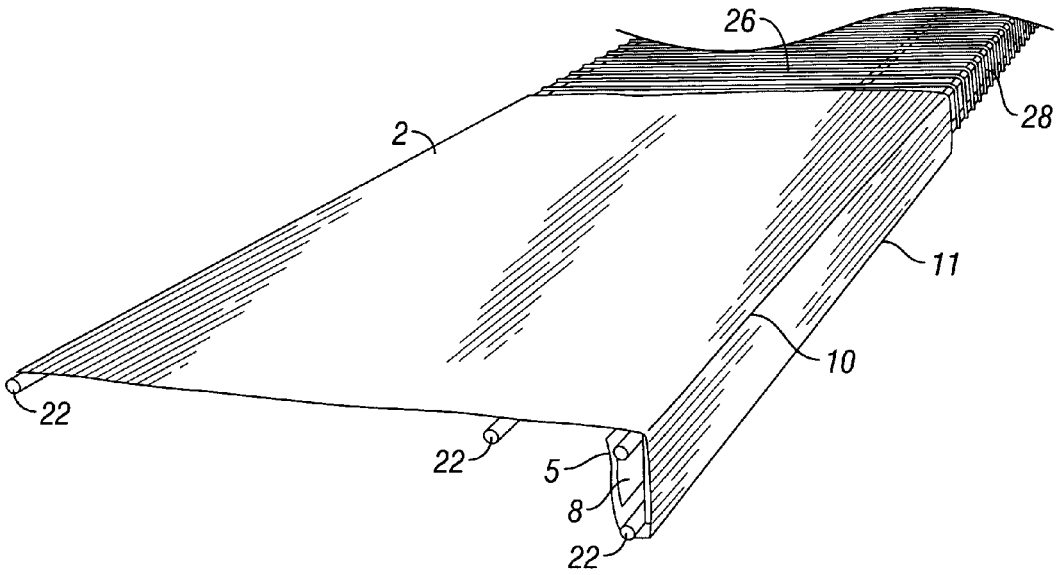
FIGS. 4, 5 and 6 are top perspective views of the present invention applied to a wire shelf.
Figure 5:
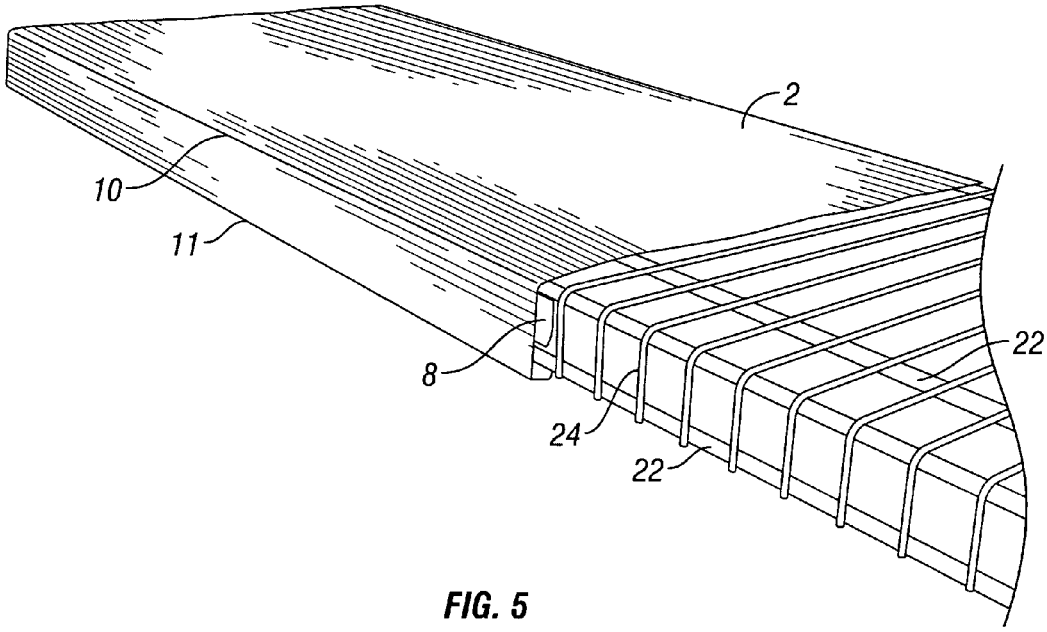
Figure 6:
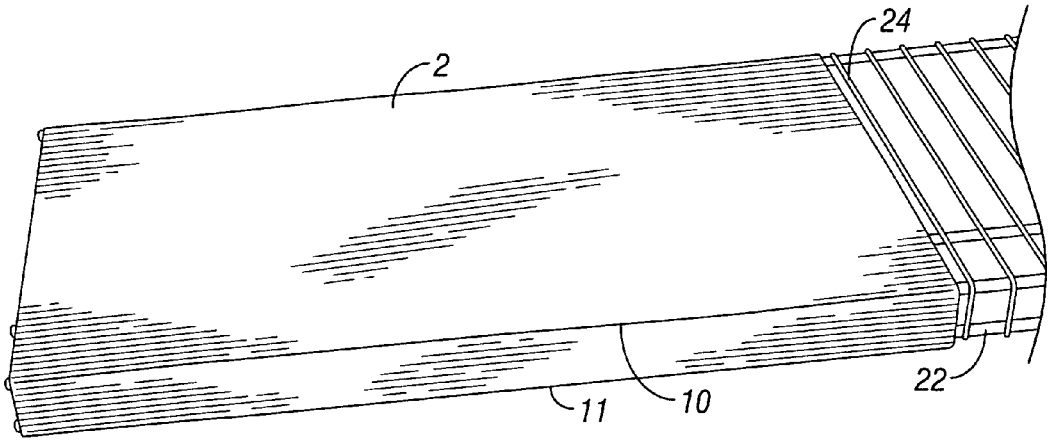
Figure 7:
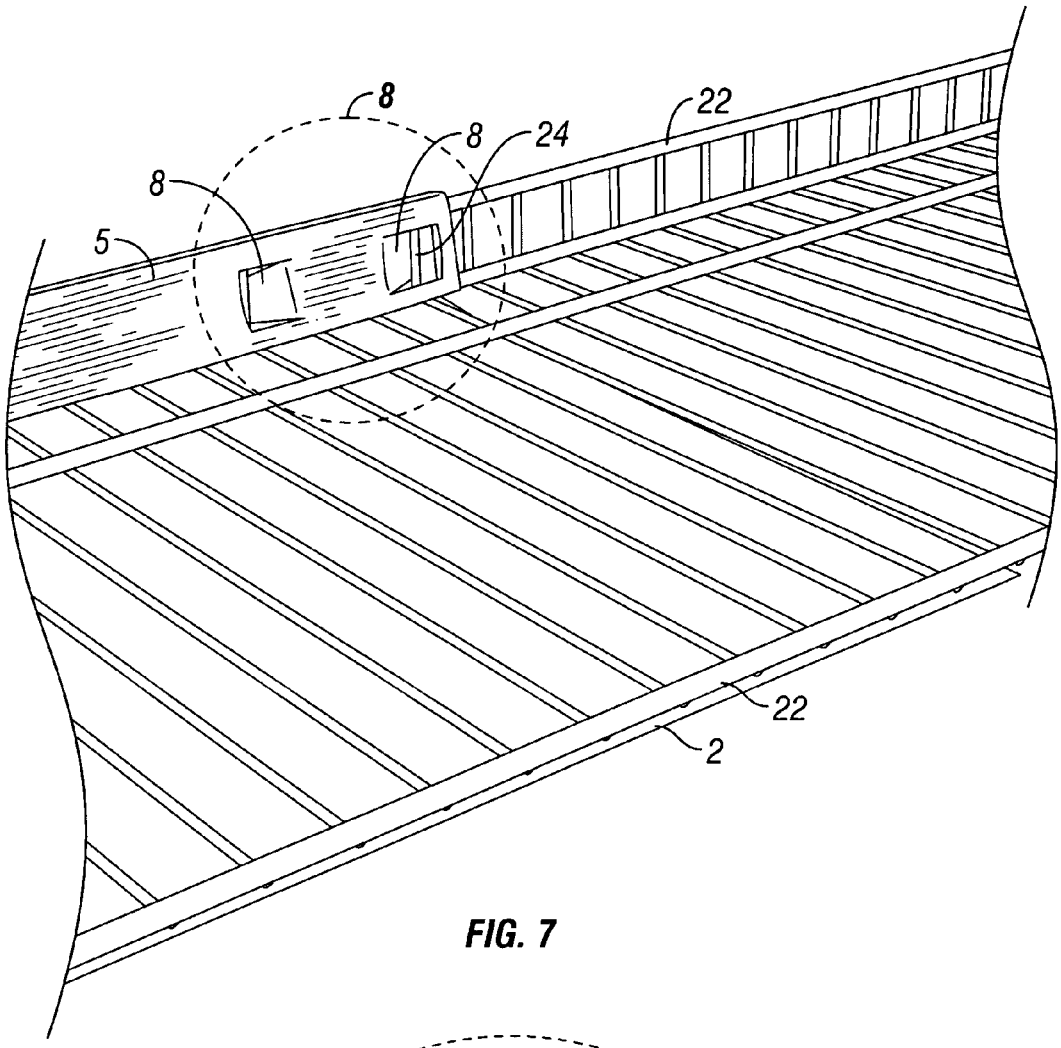
FIG. 7 is another bottom view of the wire shelf depicting the opposite end of the cover secured to the shelf.
Figure 8:
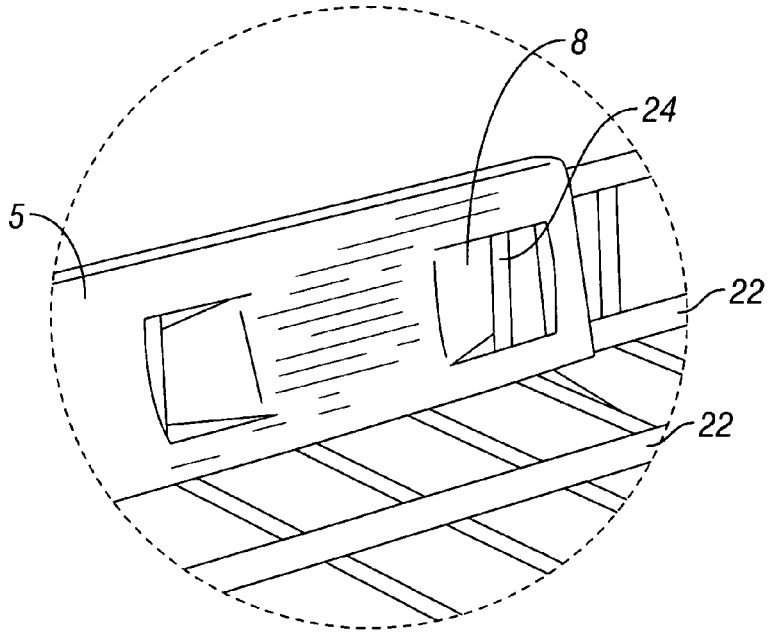
FIG. 8 depicts a detailed view of the cover of FIG. 7, further illustrating the tab method of securing the opposite end of the cover to the shelf.

In one embodiment, the extended portion 5 includes a plurality of tabs 8 adapted to fit securely behind the wires 24 of the front panel 28. Such tabs 8 can be formed by cuts made into the sheet 2 at the manufacturing stage. The tabs 8 are preferably long enough so as to be inserted completely under the wires 24, and such that they will not be easily dislodged therefrom. Such tabs 8 can be formed in opposite directions, as shown in FIGS. 2 and 8, along the entire length of the extended portion 5. In this manner, the sheet 2 is secured at numerous locations to prevent displacement from the shelf 20.

Figure 9:
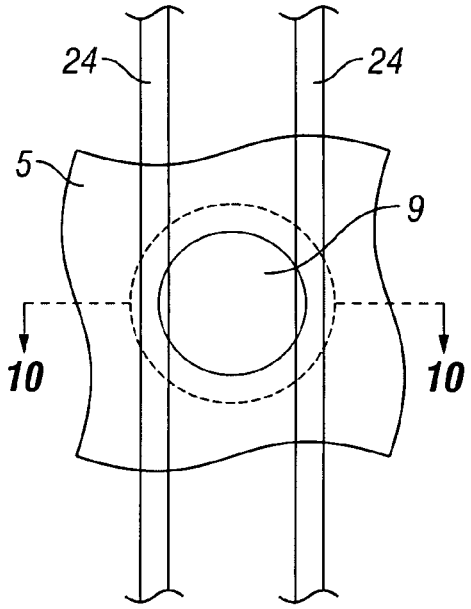
FIG. 9 depicts an alternate embodiment of the present invention illustrating an adhesively attached button for securing the cover to the wire shelf.
Figure 10:
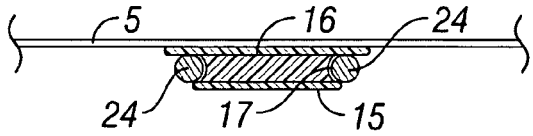
FIG. 10 depicts a sectional view of the embodiment of FIG. 9 in a secured configuration.
Figure 11:
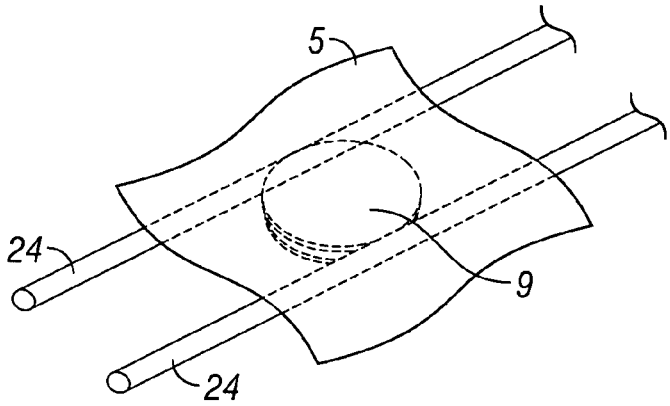
FIG. 11 depicts a perspective view of the embodiment of FIG. 9.

In another embodiment, shown more particularly in FIGS. 9-11, the extended portion 5 includes a plurality of retaining buttons 9 adapted to fit securely between adjacent wires 24 of the front panel 28. Retaining buttons 9 are preferably constructed of a resilient material having an upper and lower surface 15, 16, as well as a circumferential groove 17. The dimensions of the retaining buttons 9 are such that when a retaining button 9 is inserted between adjacent wires 24, the resiliency of the material snaps securely into place with the wires 24 residing within the groove 17. The lower surface 16 of the retaining button 9 (as shown in FIG. 10) may include an adhesive backing and would be applied to the extended portion 5 of the sheet 2 during installation at any number of points as desired by the user.

In order to accomplish the goal of being semi-rigid and serving as a continuous shelf, the sheet 2 is between about 1 and 5 mm in thickness and capable of being cut to a predetermined length. Regardless of specific configuration, the shelf covering sheet 2 should desirably be impervious to water and most household chemicals, making it durable and easy to clean. The sheet is therefore formed from a compound such as polycarbonate (PC), acrylonitrile butadiene styrene (ABS), polyphenylene oxide (PPO), high-density polyethylene (HDPE), polyethyene terephthalate (PET), polyvinyl chloride (PVC), polypropylene (PP), and polystyrene (PS), or blends thereof. In a more specific embodiment, the sheet 2 may be pigmented in a predetermined color or it may be at least partially translucent.

To facilitate installation of the shelf cover, the sheet 2 includes score lines 10 corresponding to folds in the sheet 2 when applied to the open-wire shelving. For example, for shelving having a depth of 12 inches, the first score line 10 would be located at 12 inches from the edge of the sheet and extending longitudinally along the sheet. The next score line 11 would be located at approximately 2 inches below the first score line, assuming a front panel 28 height of 2 inches. Finally, a third score line 12 would be located approximately ¼" inch from the second score line 11 (the approximate width of the lower rod 22). Thus, the score lines 10-12 would allow folds at locations which present a neat and finished look when installed. Optionally, the sheet 2 may include perforations (not shown) sufficient to permit air circulation through the shelf cover.

Figure 12:
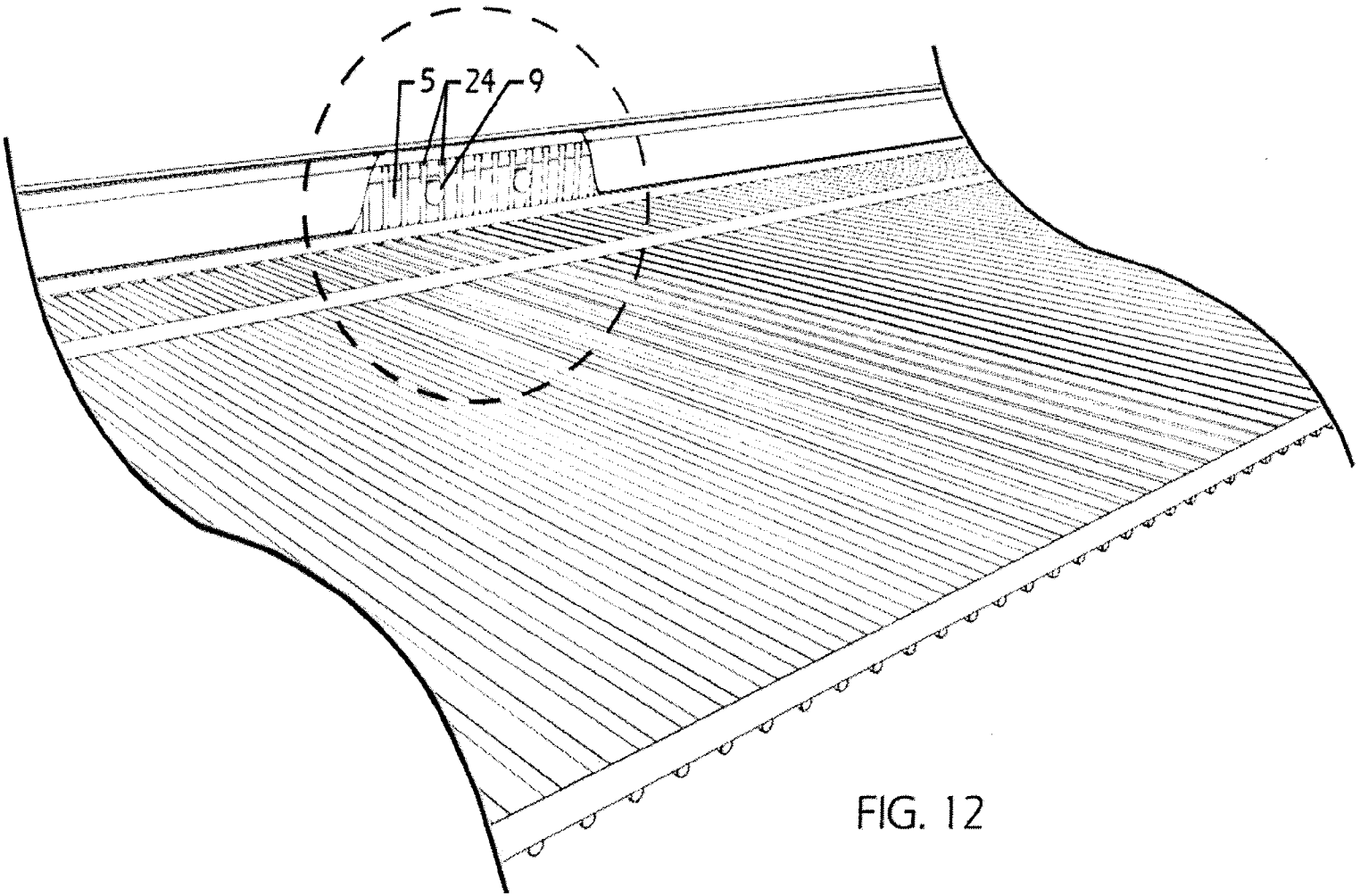
FIG. 12 depicts a bottom view of a typical wire shelf having a cover in accordance with an embodiment of the invention.
Figure 13:
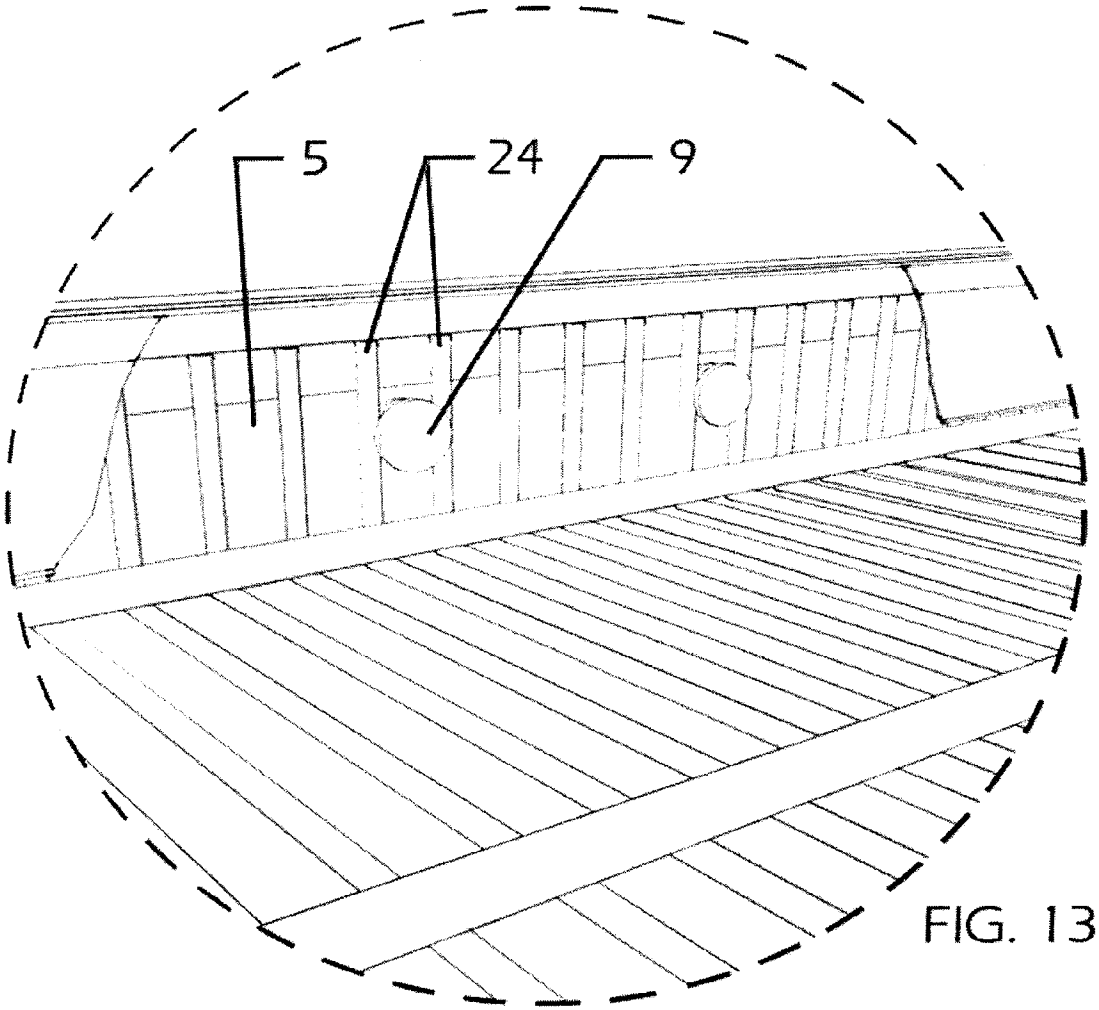
FIG. 13 depicts a detailed view of the cover of FIG. 12, further illustrating a button method of securing one end of the cover to the shelf.

The installation of the shelf cover sheet 2 onto a wire-frame shelf 20 that includes a front panel 28 is achieved by simply laying down the sheet 2 on the top panel 24 with the rear edge of the sheet 2 against the wall. The sheet 2 is then folded around the front panel 28 such that the extended portion 5 is flush with the rear of the front panel 28. If the tabs 8 are employed, the tabs 8 are pushed behind the wires 24 to secure the sheet 2. If the retaining buttons 9 are employed, the retaining buttons 9 are adhered to the desired locations, and the buttons 9 are simply pushed into place between the wires 24. An installation of the shelf cover sheet 2 using retaining buttons 9 is depicted in FIGS. 12 and 13 according to an embodiment of the invention.

As can be seen for the foregoing description of the preferred and alternate embodiments, the present invention is intended to provide a more finished look for typical wire storage systems. Although the primary market for the product is for residential applications, other grades and styles can be developed for commercial, institutional or industrial uses. Although exemplary embodiments of the present invention have been shown and described, many changes, modifications, and substitutions may be made by one having ordinary skill in the art without necessarily departing from the spirit and scope of the invention.

I claim:

1. A shelf cover assembly for use with open-wire shelving, said open-wire shelving having a top panel and a front panel, said shelf cover assembly comprising:

a semi-rigid sheet covering said top panel and said front panel of said open-wire shelving, said semi-rigid sheet comprising an extended portion dimensioned to wrap under said front panel; and a plurality of retaining buttons securely engaged between adjacent wires of said front panel, each of said plurality of retaining buttons comprising an adhesive backing that engages said extended portion at a plurality of points along said extended portion to secure said extended portion to wires of said front panel.

2. The shelf cover assembly of claim 1, wherein said sheet is between about 1 and 5 mm in thickness and capable of being cut to a predetermined length.

3. The shelf cover assembly of claim 1, wherein said sheet is formed from a compound selected from the group consisting of: polycarbonate (PC), acrylonitrile butadiene styrene (ABS), polyphenylene oxide (PPO), high-density polyethylene (HDPE), polyethyene terephthalate (PET), polyvinyl chloride (PVC), polypropylene (PP), and polystyrene (PS), and blends thereof.

4. The shelf cover assembly of claim 1, wherein said sheet is pigmented in a predetermined color.

5. The shelf cover assembly of claim 1, wherein said sheet is at least partially translucent.

6. The shelf cover assembly of claim 1, wherein said sheet includes score lines corresponding to folds in said sheet when applied to said open-wire shelving.

7. The shelf cover assembly of claim 1, wherein said sheet includes perforations sufficient to permit air circulation through said sheet.

8. The shelf cover assembly of claim 1, wherein each of said plurality of retaining buttons further defines a circumferential groove that receives said adjacent wires.

9. The shelf cover assembly of claim 1, wherein each of said plurality of retaining buttons is formed of a resilient material, and each of said buttons snaps securely into place between said adjacent wires.

10. A shelf cover for use with open-wire shelving, said open-wire shelving having a top panel and a front panel, said shelf cover comprising:

a semi-rigid sheet covering said top panel and said front panel of said open-wire shelving, said semi-rigid sheet comprising an extended portion dimensioned to wrap under said front panel, wherein:

said extended portion comprises a plurality of retaining buttons located along a plurality of points on said extended portion; and each of said plurality of retaining buttons securely engages between adjacent wires of said front panel to secure said extended portion to wires of said front panel.

11. A method of assembling a shelf cover for use with open-wire shelving, said open wire shelving having a top panel and a front panel, said method comprising the steps of:

engaging a plurality of retaining buttons comprising an adhesive backing between adjacent wires of said front panel of said open-wire shelving;

placing a semi-rigid sheet comprising an extended portion over said top panel and said front panel of said open-wire shelving;

wrapping said extended portion under said front panel; and engaging said adhesive backing for each of said plurality of retaining buttons at a plurality of point along said extended portion to secure said extended portion to wires of said front panel.

* * * * *